US011508220B2

(12) United States Patent
Cong

(10) Patent No.: US 11,508,220 B2
(45) **Date of Patent: *Nov. 22, 2022**

(54) GAMING SYSTEM AND METHOD WITH MATCHING IMAGE FEATURE

(71) Applicant: Aimin Cong, Las Vegas, NV (US)

(72) Inventor: Aimin Cong, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/242,295

(22) Filed: Apr. 27, 2021

(65) Prior Publication Data

US 2021/0350679 A1 Nov. 11, 2021

Related U.S. Application Data

(63) Continuation of application No. 16/280,026, filed on Feb. 19, 2019, now Pat. No. 10,991,211.

(60) Provisional application No. 62/631,606, filed on Feb. 16, 2018.

(51) Int. Cl.
*G07F 17/32* (2006.01)
*G07F 17/34* (2006.01)

(52) U.S. Cl.
CPC ..... *G07F 17/34* (2013.01); *G07F 17/326* (2013.01); *G07F 17/3213* (2013.01); *G07F 17/3225* (2013.01); *G07F 17/3244* (2013.01); *G07F 17/3262* (2013.01); *G07F 17/3267* (2013.01)

(58) Field of Classification Search
None
See application file for complete search history.

(56) References Cited

U.S. PATENT DOCUMENTS

| | | | | |
|---|---|---|---|---|
| 7,192,347 | B1 * | 3/2007 | Marks | G07F 17/3209 463/19 |
| 2003/0203752 | A1 * | 10/2003 | Kaminkow | G07F 17/3244 463/20 |
| 2005/0261052 | A1 * | 11/2005 | Dunaevsky | G07F 17/34 463/20 |
| 2008/0113735 | A1 * | 5/2008 | Maya | G07F 17/32 463/20 |
| 2008/0113739 | A1 * | 5/2008 | Visser | G07F 17/34 463/20 |
| 2016/0180639 | A1 * | 6/2016 | Ditton | G07F 17/3213 463/20 |
| 2018/0130285 | A1 * | 5/2018 | Ang | G07F 17/3244 |

* cited by examiner

*Primary Examiner* — Jason T Yen
(74) *Attorney, Agent, or Firm* — Newman Law, LLC

(57) ABSTRACT

Gaming systems and methods for providing a game and/or game feature in which images are divided in parts to form symbols or symbol parts, with the symbol parts being included in separate reels or groups from which they are randomly selected for display on a game screen, such as an array or grid formed by rows and columns. A winning or award outcome is determined based on the random game results displaying a completed image formed of the randomly displayed matching symbol parts.

6 Claims, 4 Drawing Sheets

GAMING SYSTEM AND METHOD WITH MATCHING IMAGE FEATURE

CROSS-REFERENCE TO RELATED APPLICATIONS

This application is a continuation of U.S. Non-Provisional application Ser. No. 16/280,026 filed Feb. 19, 2019, issued as U.S. Pat. No. 10,991,211 on Apr. 27, 2021, which claims the priority benefit of U.S. Provisional Patent Application No. 62/631,606 filed Feb. 16, 2018, the disclosure of which is incorporated herein by reference.

BACKGROUND OF THE INVENTION

The invention relates generally to electronic gaming equipment, and more particularly, to an electronic gaming machines, games and special promotional features that may be offered to facilitate and encourage game play thereon.

Gaming machines, such as slot machines, video poker machines, and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. In situations where the available gaming options include a number of competing machines and the expectation of winning each machine is roughly the same (or believed to be the same), players are most likely to be attracted to the gaming machines that the most entertaining and exciting, or otherwise which each player happens to find most appealing. Consequently, shrewd operators strive to employ a wide variety of gaming machines, including the most entertaining and exciting machines available, because such machines attract frequent play and, hence, increase profitability to the operator.

Many slot games employ a plurality of paylines for determining award outcomes. The advent of electronics, computers and electronic graphical displays, has enabled a continual increase in the complexity. Games typically include multiple paylines, many of which are not straight lines, and each cell may comprise a reel, such that every symbol in each cell is randomly selected. The paylines can be numerous and thus players sometimes are unable to easily discern the basis for a winning or losing outcome.

Accordingly, in the competitive gaming machine industry, there is a continuing need for gaming machine manufacturers to produce new types of games, gaming play features and enhancements to existing games, including games that are easier for players to determine the basis for the game outcome and award amount, and which will also attract frequent play by enhancing the entertainment value and excitement associated with the game.

SUMMARY OF THE INVENTION

The present disclosure is directed to, among other things, address the issues cited above. Some embodiments of the present disclosure are directed to gaming systems and methods for providing a game and/or game feature in which images are divided in parts to form symbols or symbol parts, with the symbol parts being included in separate reels or groups from which they are randomly selected for display on a game screen, such as an array or grid formed by rows and columns. A winning or award outcome is determined based on the random game results displaying a completed image formed of the randomly displayed matching symbol parts.

Some embodiments of the invention are directed to a gaming system, comprising: a housing; at least one display device supported by the housing; one or more input devices; at least one processor; and at least one memory device that stores a plurality of instructions that, when executed by the at least one processor, cause the at least one processor to communicate with the at least one display device and the one or more input devices to: a) establish a credit balance through the one or more input devices; b) receive a wager through the one or more input devices to initiate play of a wagering game, the credit balance being decreasable by the wager; c) randomly display an outcome of an instance of play of the wagering game, wherein the displayed game outcome includes a depiction of an array formed by at least one row and two columns defining adjacent first and second cells, the first cell having a first symbol part of a plurality of first symbol parts stored in the memory device and being randomly selected for display in the first cell, the second cell having a second symbol part of a plurality of second symbol parts stored in the memory device being randomly selected for display in the second cell, wherein each first symbol part of the plurality of first symbol parts stored in the memory device includes at least one second symbol part of the plurality of second symbol parts stored in the memory device defined by the at least one processor as being a matching symbol part; d) determine an award outcome based on a matching first and second symbol part being randomly displayed in the array of the instance of play of the wagering game, wherein each of the matching first and second symbol parts form a completed symbol, the completed symbol identifying a corresponding award amount; and e) responsive to the determination of the award outcome, increasing the credit balance by the determined award amount.

In some embodiments, each first symbol part and each matching second symbol part form a completed unique image. The unique image may comprise a representation of currency, and the currency may identify an amount of credits. In some embodiments, the award determined by the at least one processor is equal in credits the identified amount of credits.

Some embodiments of the invention are directed to a gaming system, comprising: a housing; at least one display device supported by the housing; one or more input devices; at least one processor; a random number generator; and at least one memory device that stores a plurality of instructions that, when executed by the at least one processor, cause the at least one processor to communicate with the at least one display device, the random number generator and the one or more input devices to: a) establish a credit balance through the one or more input devices; b) receive a wager through the one or more input devices to initiate play of a wagering game, the credit balance being decreasable by the wager; c) randomly display an outcome of an instance of play of the wagering game, wherein the displayed game outcome includes a depiction of an array formed by at least one row and two columns defining adjacent first and second cells, the first cell having a first half image of a plurality of first half images stored in the memory device and being randomly selected for display in the first cell, the second cell having a second half image of a plurality of second half images stored in the memory device being randomly selected for display in the second cell, wherein each first half image of the plurality of first half images stored in the memory device includes at least one second half image of the plurality of second half images stored in the memory device defined by the at least one processor as being a matching half image, wherein the matching first and second half images form a complete image, the complete image identifying a credit award; d) determine an award outcome based on the display of a complete image in the outcome of the instance of play of the wagering game, wherein the award outcome is equal to the credit award identified by the complete image; and e) responsive to the determination of the award outcome, increasing the credit balance by the determined credit award.

Some embodiments of the invention are directed to a gaming system, comprising: a housing; at least one display device supported by the housing; one or more input devices, wherein at least one of the one or more input devices is a payment device configured to receive a transfer of a monetary amount; at least one processor; a random number generator; and at least one memory device that stores a plurality of instructions that, when executed by the at least one processor, cause the at least one processor to communicate with the at least one display device, the random number generator and the one or more input devices to: a) establish a credit balance relating to the monetary amount received through the one or more input devices; b) receive a wager through an interaction with the one or more input devices to initiate play of a wagering game, the wager being associated with a credit amount and the credit balance being decreasable by the credit amount of the wager; c) randomly display on the at least one display device supported by the housing an outcome of an instance of play of the wagering game, wherein the displayed game outcome includes a depiction on the at least one display device of an array formed by at least one row and two columns defining adjacent first and second cells, the first cell having a first half image of a plurality of first half images stored in the at least one memory device, the first half image being randomly selected by the at least one processor in communication with the random number generator for display in the first cell, the second cell having a second half image of a plurality of second half images stored in the memory device being randomly selected by the at least one processor in communication with the random number generator for display in the second cell, wherein each first half image of the plurality of first half images stored in the at least one memory device includes at least one second half image of the plurality of second half images stored in the at least one memory device defined by the at least one processor as being a matching half image, wherein the matching first and second half images form a unitary image, the unitary image formed being one of non-matching images of a currency or matching images of a currency, the unitary image formed of matching images of a currency identifying a credit award; d) determine an award outcome based on the unitary image formed of matching images of a currency in the displayed outcome of the instance of the wagering game, wherein the award outcome is equal to the credit award identified by the unitary image formed of matching images; and e) responsive to the determination of the award outcome, increase the credit balance by the determined credit award.

In some embodiments of the aforementioned system, the payment device comprises a ticket acceptor.

In some embodiments of the aforementioned system, the credit award is identified responsive to the formation of the unitary image formed of matching images.

Some embodiments of the invention are directed to a gaming system, comprising: one or more input devices, wherein at least one of the one or more input devices includes a display device and a data communication device; at least one processor; a random number generator; and one or more memory devices that store a plurality of instructions that, when executed by the at least one processor, cause the at least one processor to communicate with the data communication device of the at least one of the one or more input devices including the display device and the random number generator to: a) establish a credit balance in the one or more memory devices; b) receive a wager through an interaction with the at least one of the one or more input devices including the display device to initiate play of a wagering game, the wager being associated with a credit amount and the credit balance being decreasable by the credit amount of the wager; c) randomly display on the at least one of the one or more input devices including the display device an outcome of an instance of play of the wagering game, wherein the displayed game outcome includes a depiction on the display device of an array formed by at least one row and two columns defining adjacent first and second cells, the first cell having a first half image of a plurality of first half images stored in the one or more memory devices, the first half image being randomly selected by the at least one processor in communication with the random number generator for display in the first cell, the second cell having a second half image of a plurality of second half images stored in the one or more memory devices being randomly selected by the at least one processor in communication with the random number generator for display in the second cell, wherein each first half image of the plurality of first half images stored in the one or more memory devices includes at least one second half image of the plurality of second half images stored in the one or more memory devices defined by the at least one processor as being a matching half image, wherein the matching first and second half images form a complete image, the complete image formed being one of non-matching images of a currency or matching images of a currency, the complete image formed of matching images of a currency identifying a credit award; d) determine an award outcome based on the complete image formed of matching images of a currency in the displayed outcome of the instance of the wagering game, wherein the award outcome is equal to the credit award identified by the complete image formed of matching images; and e) responsive to the determination of the award outcome, increase the credit balance by the determined credit award.

Some embodiments of the invention are directed to a method facilitated by one or more input devices, wherein at least one of the one or more input devices includes a display device and a data communication device; at least one processor; a random number generator; and one or more memory devices that store a plurality of instructions, the at least one processor executing the plurality of instructions and communicating with the data communication device of the at least one of the one or more input devices including the display device, the method comprising the steps of: establishing a credit balance in the one or more memory devices; receiving a wager through an interaction with the at least one of the one or more input devices including the display device to initiate play of a wagering game, the wager being associated with a credit amount and the credit balance being decreasable by the credit amount of the wager; randomly displaying on the at least one of the one or more input devices including the display device an outcome of an instance of play of the wagering game, wherein the displayed game outcome includes a depiction on the display device of an array formed by at least one row and two columns defining adjacent first and second cells, the first cell having a first half image of a plurality of first half images stored in the one or more memory devices, the first half image being randomly selected by the at least one processor in communication with the random number generator for display in the first cell, the second cell having a second half image of a plurality of second half images stored in the one or more memory devices being randomly selected by the at least one processor in communication with the random number generator for display in the second cell, wherein each first half image of the plurality of first half images stored in the one or more memory devices includes at least one second half image of the plurality of second half images stored in the one or more memory devices defined by the at least one processor as being a matching half image, wherein the matching first and second half images form a unitary image, the unitary image formed being one of non-matching images of a currency or matching images of a currency, the unitary image formed of matching images of a currency identifying a credit award; determining an award outcome based on the unitary image formed of matching images of a currency in the displayed outcome of the instance of the wagering game, wherein the award outcome is equal to the credit award identified by the unitary image formed of matching images; and responsive to the determination of the award outcome, increasing the credit balance by the determined credit award.

In some embodiments the aforementioned method may further comprise the step of identifying the credit award responsive to the formation of the unitary image formed of matching images.

BRIEF DESCRIPTION OF THE DRAWINGS

Other advantages of the invention will be readily appreciated as the same becomes better understood by reference to the following detailed description when considered in connection with the accompanying drawings wherein.

DETAILED DESCRIPTION OF THE INVENTION

Figure 1:
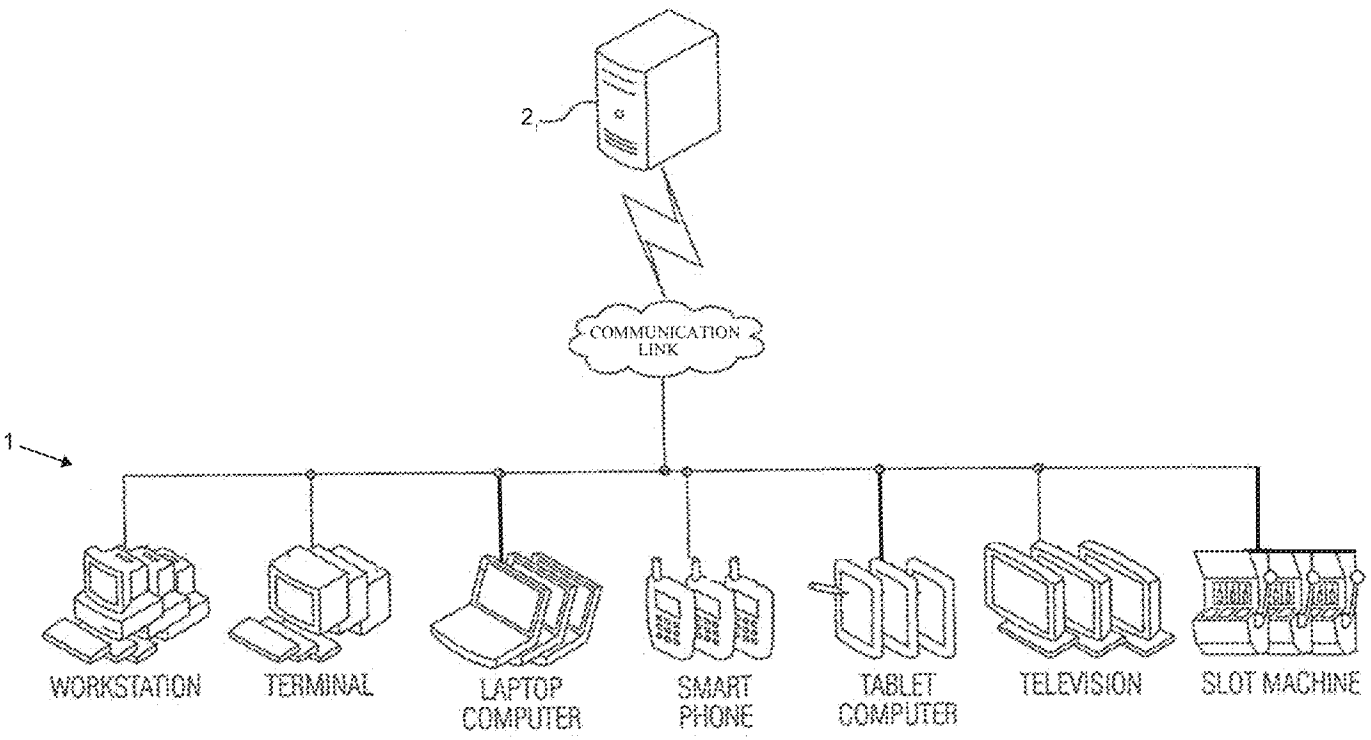
FIG. 1 is a schematic representation of various examples of gaming systems which may be used with embodiments of the invention.

The following detailed description provides systems and methods for implementing features in gaming applications. The gaming applications may be implemented in accordance or in conjunction with one or more of a variety of different types of gaming systems, such as those described herein, including computer-based platforms which may be specially configured for the provision of wagering games, such as electronic gaming machines, or other devices which are not specially configured for the provision of wagering games, such as a smartphone, but which can be enabled as a platform through which such gaming applications including the game features of the invention can be made accessible. Embodiments of the invention therefore contemplate a variety of different gaming systems in and through which gaming applications of the invention may be employed, each gaming system having one or more of a plurality of different features, attributes, or characteristics as disclosed herein.

It should be understood that some gaming systems include gaming machines, such as electronic gaming machines, are implemented with special features and/or additional circuitry that differentiates them from general-purpose computers (e.g., desktop PC's and laptops). Gaming machines are highly regulated to ensure fairness and, in many cases, gaming machines are operable to dispense substantial monetary awards. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional or different components and features found in gaming machines are described below.

Though both personal computers, or personal computing devices as the term is used herein, and gaming machines employ microprocessors that control a variety of devices, adapting technology used in personal computers to a gaming machine can be quite difficult because of reasons such as the regulatory requirements that are placed upon gaming machines, the harsh environment in which gaming machines operate, security requirements and fault tolerance requirements. Further, techniques and methods for solving a problem in the computer industry, such as device compatibility and connectivity issues, might not be adequate in the gaming environment. For instance, a fault or a weakness tolerated in a personal computer, such as security holes in software or even frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between personal computer devices and gaming systems will be described. A first difference between gaming machines and common personal computer devices and systems based on personal computer devices is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and then before the award could be provided to the player the power failed, the gaming machine, upon the restoration of power, would return to the state where the award is indicated. The need to provide a state-based system affects the software and hardware design on a gaming machine.

A second important difference between gaming machines and common personal computer devices or personal computer-based systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator or player of a gaming machine from manipulating hardware and software in a manner that gives them an unfair and some cases an illegal advantage. The gaming machine should have a means to determine if the code it will execute is valid. If the code is not valid, the gaming machine must have a means to prevent the code from being executed. The code validation requirements in the gaming industry affect both hardware and software designs on gaming machines.

A third important difference between gaming machines and common personal computer devices and personal computer-based systems is the number and kinds of peripheral devices used on a gaming machine are not as great as on personal computer based computer systems. Traditionally, in the gaming industry, gaming machines have been relatively simple in the sense that the number of peripheral devices and the number of functions the gaming machine has been limited. Further, in operation, the functionality of gaming machines are relatively constant once the gaming machine was deployed, and new peripherals devices and new gaming software are infrequently added to the gaming machine. This differs from a personal computer where users often buy different combinations of devices and software from different manufacturers and connect them to a computer to suit their needs. Therefore, the types of devices connected to a personal computer may vary greatly from user to user depending in their individual requirements and may vary significantly over time.

Although the variety of devices available for a personal computer may be greater than on a gaming machine, gaming machines still have unique device requirements that differ from a personal computer, such as device security requirements not usually addressed by personal computers. For instance, monetary devices, such as coin dispensers, bill validators and ticket printers and computing devices that are used to govern player accounts, credit and debit player account balances and handle the input and output of cash to a gaming machine have security requirements that are not typically addressed in personal computers. Therefore, many personal computer techniques and methods developed to facilitate device connectivity and device compatibility do not address the emphasis placed on security in the gaming industry.

The foregoing notwithstanding, features of the invention may be implemented on both gaming machines and personal computing devices or other devices which are not specially configured for the provision of a wagering game and therefore may lack components typically included in gaming machines. Accordingly, a gaming system as used herein refers to any and all of the foregoing machines and devices, including various configurations that may include one or more central servers, central controllers, or remote hosts, one or more electronic gaming machines and/or one or more devices which are not specially configured for the provision of a wagering game, such as desktop computers, laptop computers, tablet computers or computing devices, televisions, personal digital assistants (PDAs), mobile telephones such as smart phones, and other mobile computing devices, all of which are collectively referred to by the term personal computing devices used herein.

Thus, in various embodiments, the gaming system of the present disclosure may include: one or more electronic gaming machines in combination with one or more central servers, central controllers, or remote hosts; one or more personal computing devices in combination with one or more central servers, central controllers, or remote hosts; one or more personal computing devices in combination with one or more electronic gaming machines; one or more personal computing devices, one or more electronic gaming machines, and one or more central servers, central controllers, or remote hosts in combination with one another; a single electronic gaming machine; a plurality of electronic gaming machines in combination with one another; a single personal computing device; a plurality of personal computing devices in combination with one another; a single central server, central controller, or remote host; and/or a plurality of central servers, central controllers, or remote hosts in combination with one another. In the various embodiments, the personal computing devices and/or electronic gaming machines are configured to communicate with one another and/or the central server, central controller or remote host through a communication link, such as a local or wide area data network, closed, intranet or open system or remote link such as the Internet.

FIG. 1 illustrates a schematic of exemplary gaming system hardware and network platform that can be used to implement embodiments of the invention. The system includes gaming systems such as electronic gaming machines and plurality of personal computing devices, all of which are in communication with the same or different one or more central servers 2 through one or more communication links, which may include a data networks and the internet. Exemplary personal computing devices shown in FIG. 1 include workstations, terminals (including self-service wagering terminals), laptops or other internet connected computing systems, mobile or smart phones, tablet computers and televisions. For brevity and clarity, each gaming system, that is, electronic gaming machines and personal computing devices connected to a server 2 as shown in FIG. 1 or mentioned herein and any equivalents thereto will be collectively referred to by the term "EGM." Additionally, for brevity and clarity, unless specifically stated otherwise, an EGM as used herein represents one EGM or a plurality of EGMs, and a central server, central controller, or remote host as used herein represents one central server, central controller, or remote host or a plurality of central servers, central controllers, or remote hosts. Thus, the EGMs shown in FIG. 1 are generally designated by the reference numeral 1.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games, any secondary or bonus games and/or any non-primary and non-secondary games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: an EGM configured to communicate with a central server, central controller, or remote host through a data network; and/or a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: an EGM configured to communicate with a central server, central controller, or remote host through a data network; and/or a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: in an area of a gaming establishment different from an area of the gaming establishment in which the central server, central controller, or remote host is located; or in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: an EGM configured to communicate with a central server, central controller, or remote host through a data network; and/or a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the communication link, data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs).

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM. In other embodiments, at least one of the at least one processor of the EGM and the at least one memory device of the EGM reside outside the cabinet of the EGM In certain embodiments, as generally described herein, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games, secondary or bonus games and any non-primary and non-secondary games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

In various embodiments, the EGM includes one or more input devices. The input devices may include any suitable device that enables an input signal to be produced and received by the at least one processor of the EGM. One input device of the EGM may be a payment device configured to communicate with the at least one processor of the EGM to fund the EGM or a player account which is capable of funding the EGM. In certain embodiments, the payment device includes one or more of: a bill acceptor into which paper money is inserted to fund the EGM; a ticket acceptor into which a ticket or a voucher is inserted to fund the EGM; a coin slot into which coins or tokens are inserted to fund the EGM; a reader or a validator for credit cards, debit cards, or credit slips into which a credit card, debit card, or credit slip is inserted to fund the EGM; a player identification card reader into which a player identification card is inserted to fund the EGM; through communication with a bank account or mobile device, such as a smartphone, or other account configured for transferring funds or cryptocurrency to the EGM upon authorization by a player; or any suitable combination thereof.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display.

Figure 2:
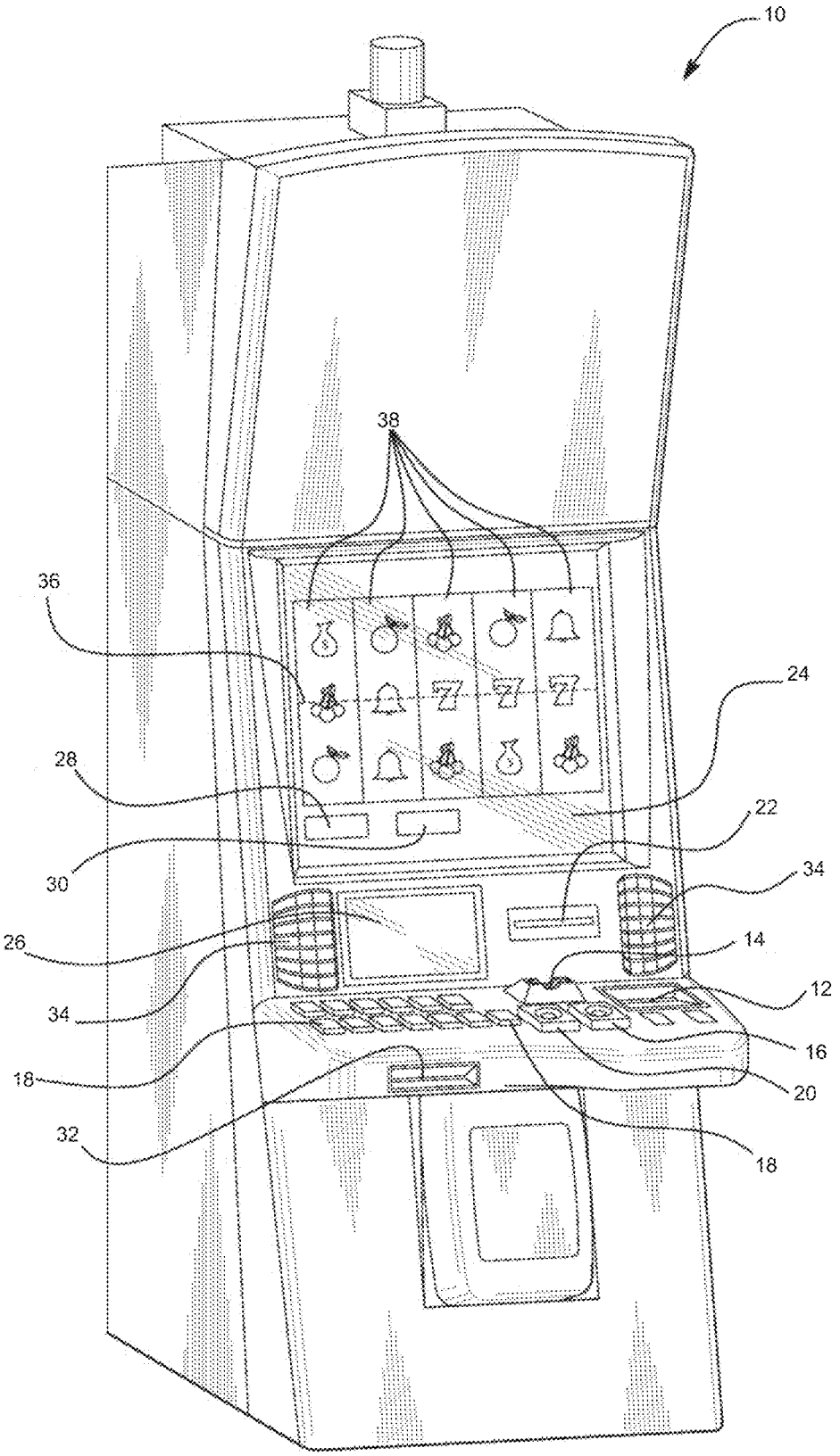
FIG. 2 is a perspective view of an exemplary embodiment of an electronic gaming machine which may be used with some embodiments of the invention.

FIG. 2 illustrates an exemplary EGM of the general type and form which may be fabricated and commercialized by any of the various gaming manufacturers generally indicated by the reference numeral 10. EGM 10 includes payment devices including a combined bill and ticket acceptor 12, and a player loyalty card receiving slot 14.

In various embodiments, one or more input devices of the EGM are one or more game play activation devices that are each used to initiate a play of a game on the EGM or a sequence of events associated with the EGM following appropriate funding of the EGM. EGM 10 includes a game play activation device in the form of a game play initiation button 16. It should be appreciated that, in other embodiments, the EGM begins game play automatically upon appropriate funding rather than upon utilization of the game play activation device.

In certain embodiments, one or more input devices of the EGM are one or more interactive input and wagering devices. Upon the utilization of the wagering device, a quantity of credits shown in a credit display decreases, and a number of credits shown in a bet display increases. EGM 10 includes one or more input devices 18 consisting of various depressible buttons or touch sensors. In other embodiments, one input device of the EGM is also a cash out device. The cash out device is utilized to receive a cash payment or any other suitable form of payment corresponding to a quantity of remaining credits of a credit display. EGM 10 includes a cash out device in the form of a cash out button 20.

In certain embodiments, one input device of the EGM is a touch-screen coupled to a touch-screen controller or other touch-sensitive display overlay to enable interaction with any images displayed on a display device. One such input device is a conventional touch-screen button panel. The touch-screen and the touch-screen controller are connected to a video controller. In these embodiments, signals are input to the EGM by touching the touch screen at the appropriate locations.

In embodiments including a player tracking system, one input device of the EGM is a card reader in communication with the at least one processor of the EGM. EGM 10 includes a card reader 22. The card reader is configured to read a player identification card inserted into the card reader.

In various embodiments, the EGM includes one or more output devices. One or more output devices of the EGM are one or more display devices configured to display any game(s) displayed by the EGM and any suitable information associated with such game(s). In certain embodiments, the display devices are connected to or mounted on a cabinet of the EGM. In various embodiments, the display devices serves as digital glass configured to advertise certain games or other aspects of the gaming establishment in which the EGM is located. In various embodiments, the EGM includes one or more of the following display devices: a central display device; a player tracking display configured to display various information regarding a player's player tracking status; a secondary or upper display device in addition to the central display device and the player tracking display; a credit display configured to display a current quantity of credits, amount of cash, account balance, or the equivalent; and a bet display configured to display an amount wagered for one or more plays of one or more games. EGM 10 includes a central display device 24, a player tracking display 26, a credit display 28, and a bet display 30.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: a ticket generator configured to generate and provide a ticket or credit slip representing a payout, wherein the ticket or credit slip may be redeemed via a cashier, a kiosk, or other suitable redemption system; a note generator configured to provide paper currency; a coin generator configured to provide coins or tokens in a coin payout tray; and any suitable combination thereof. EGM 10 for example includes ticket generator 32. In one embodiment, the EGM includes a payout device configured to fund an electronically recordable identification card or smart card or a bank account via an electronic funds transfer.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. EGM 10 includes a plurality of speakers 34.

As generally described above, in certain embodiments, such as EGM 10, EGMs have a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. EGMs may have varying cabinet and display configurations. It should be appreciated that, in certain embodiments, the EGM is a device that has obtained approval from a regulatory gaming commission, and in other embodiments, the EGM is a device that has not obtained approval from a regulatory gaming commission.

It should be appreciated given the definition assigned to EGMs hereunder that certain of the example EGMs described above include certain elements that may not be included in all EGMs. For example, the payment device of a personal gaming device such as a smartphone may not include a player card slot.

In various embodiments, the EGM includes one or more player tracking systems. Such player tracking systems enable operators of the gaming systems (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a mobile phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions on an EGM, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device.

In various embodiments, an EGM may be implemented in one of a variety of different configurations. In various embodiments, the EGM may be implemented as one of: a dedicated EGM wherein computerized game programs executable by the EGM for controlling any primary or base games, any secondary or bonus games and any non-primary and non-secondary games or other functions displayed by the EGM are provided with the EGM prior to delivery to a gaming establishment or prior to being provided to a player; and a changeable EGM wherein computerized game programs executable by the EGM for controlling any primary games, secondary games and/or non-primary and non-secondary games displayed by the EGM are downloadable to the EGM through a data network or remote communication link after the EGM is physically located in a gaming establishment or after the EGM is provided to a player.

In some embodiments, the EGM of the invention may provide a primary and/or secondary and/or non-primary and non-secondary game which is a wholly or partially skill-based game and/or a partially or wholly randomly determined game, such as through a RNG. A winning game outcome and/or winning of an award may result in a quantity of credits being awarded to a player account established on the gaming system. In certain such embodiments, the random determination is provided through utilization of an RNG, such as a true RNG or a pseudo RNG, or any other suitable randomization process. In one such embodiment, each game outcome or award is associated with a probability, and the EGM generates the game outcome(s) and/or the award(s) to be provided based on the associated probabilities. In these embodiments, since the gaming system generates game outcomes and/or awards randomly or based on one or more probability calculations, there is no certainty that the EGM will ever provide any specific game outcome and/or award.

As discussed, the present disclosure contemplates a variety of different EGMs each having one or more of a plurality of different features, attributes, or characteristics. As noted above, in various embodiments, the EGM includes one or more executable game programs executable by at least one processor to provide any suitable games. For example, EGM 10 includes a payline 36 and a plurality of reels 38 as part of a conventional slot-type primary game involving spinning reels with each reel displaying a plurality of indicia or symbols. Suitable games may also include skill-based games and other wagering games or combinations thereof, as primary and/or secondary games. Exemplary embodiments herein below describe game features, particularly for games which may not previously be considered as a primary or a secondary game. However, each of the features of any of the games may be combined with another. Any of the features may involve or require player interaction or input, or occur automatically, either immediately along with an associated display or after a period of time has elapsed in which no player input is received, or combinations thereof. The operation of game features herein may be impacted by and a function of systems and methods configured to achieve a desired return to player ("RTP"). In some embodiments, the outcome of a game provided by the EGM may be non-redeemable, that is, the game is played for fun. In some embodiments, a benefit earned in one type of game, whether primary, secondary or through a feature which is not a primary or a secondary game, may be realized in a primary and/or secondary game.

Gaming systems of the invention may include a real-time or online accounting and gaming information system configured to communicate with the central server, central controller, or remote host. Accounting and gaming information modules in the gaming system include a player database for storing player profiles, a player tracking module for tracking players, and a credit system for providing automated transactions.

Further exemplary embodiments of gaming systems and processes and methods of operating the gaming system or EGM of the invention are described herein. Processes and methods may be represented, facilitated and carried forth by a set of instructions stored in one or more memories and executed by one or more processors which may be in communication with one or more random number generators.

In this embodiment the EGM or gaming system of the invention is configured to operate a game play or a game play feature in which a portion of a single image are divided amongst one or more adjacent reels, such that when reels randomly stop with the portions of the single image adjacent one another, the portions correspond in a plurality of characteristics to form the single image. In some embodiments, the images may be divided into parts by the gaming system and stored into memory, thus enabling existing games having a plurality of symbols stored in memory, to be modified and played according to the embodiments described herein, as well as new games in which images are first divided into various image portions prior to game play. In such embodiments, images may be divided into parts upon initiating a game or instance of the game, thus providing a different gaming experience.

Figure 3:
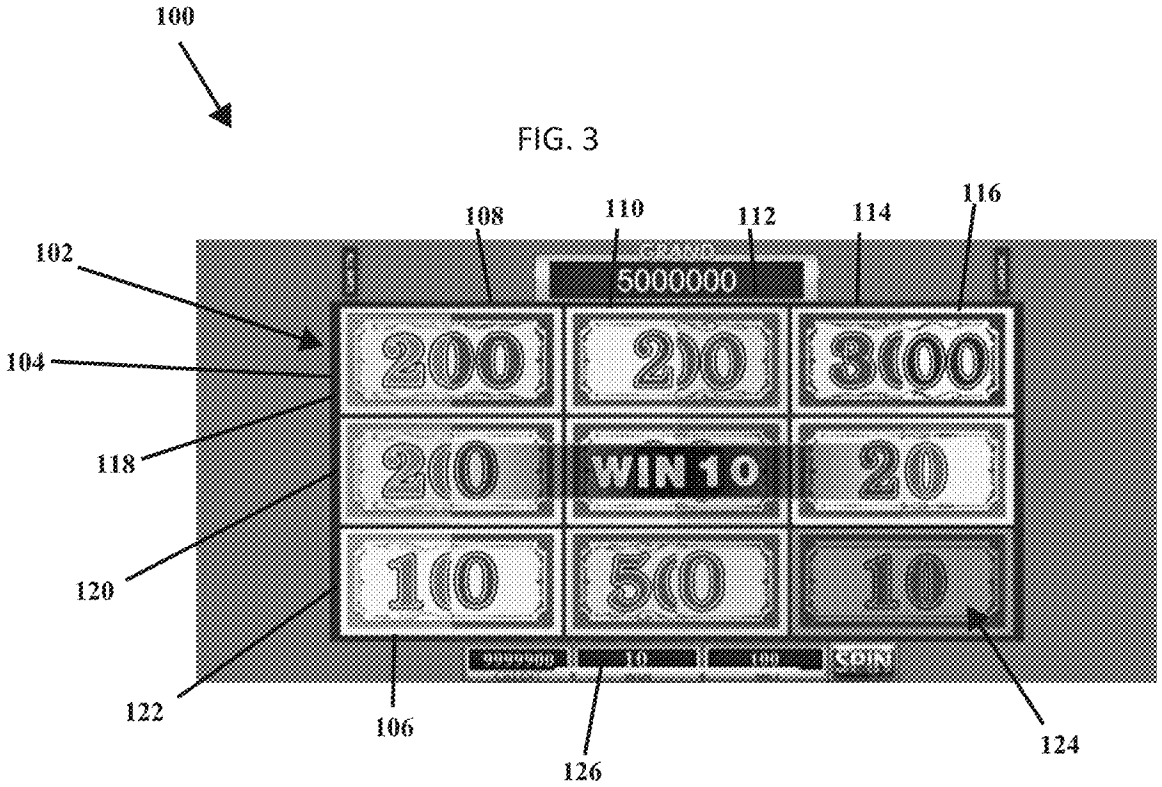
FIGS. 3 and 4 provide displays and interfaces illustrating exemplary embodiments of the gaming system of the invention.
Figure 4:
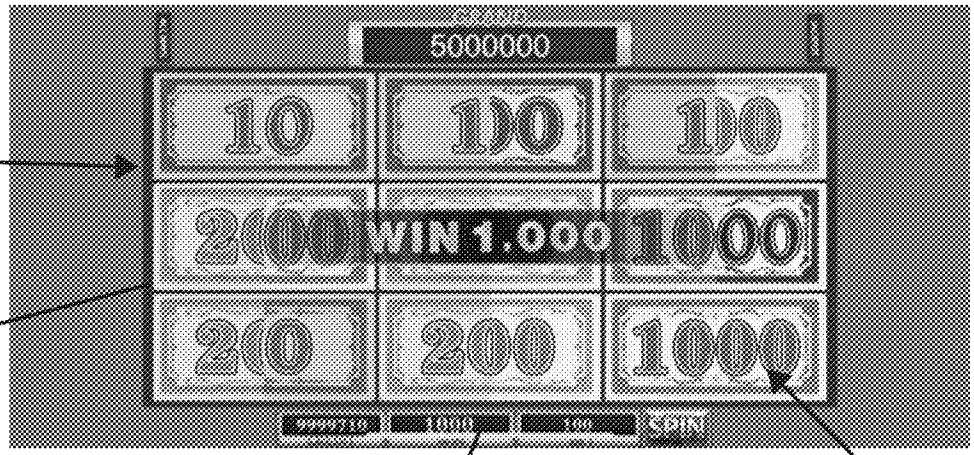

An example of a display and interface illustrating an embodiment of the invention is shown in FIGS. 3 and 4. A gaming system 100 has a display 102 with an array or grid 104 formed by six columns (from left to right as depicted on display 102) columns 106, 108, 110, 112, 114 and 116 and three rows (from top to bottom as depicted on display 102) rows 118, 120 and 122, respectively. Display 102 shows exemplary randomly generated results in which each reel strip contains a half portion of a single image, the image being of currency of a particular value. The first half portions of the single images are included as symbols in reels that correspond with the displayed grid 104 positions in columns 106, 110 and 114, whereas the corresponding other or second half portions of the single images are included as symbols in reels that correspond with the displayed grid 104 positions in columns 108, 112 and 116. Responsive to the gaming system 100 detecting a matched image, that is, when a first half portion and a second half portion are displayed in adjacent reels in the same row, system 100 further facilitates the distribution of a payout amount corresponding to the value shown by the completed image. It should be understood that the configuration of columns and rows shown in this embodiment may be changed and/or inverted in other embodiments such that the completed images are formed different, such as diagonally or by positions in adjacent rows within the same column.

For example, in FIG. 3, the grid 104 positions defined by row 120, and adjacent columns 114 and 116 include a first half image and a second half image, respectively, which together form a completed full image in collective grid position defined by reference number 124. Gaming system therefore detects this game outcome as a winning outcome and based on the full image defining a currency value of ten credits, ten credits are distributed as shown in this embodiment by the banner displayed over grid 104 and in the credit display 126. Similarly FIG. 4 illustrates a gaming system 200 with a display 202 showing a game outcome being a win of 1000 credits in adjacent columns of the same row, identified collectively as grid position 226 of grid 204. In this embodiment, each image may include various colors and designs, and thus, each half image must form the completed image of the same color and design.

It should be understood that the game play feature of this embodiment, and player interaction or input involved in the game play feature, may be initiated and/or actuated through a variety of means, such as by an input device including an interface or specifically labeled hardware button, a software button, more general interaction with a touch screen, or via contact with buttons that are labeled differently, not labelled at all, or part of a larger interface peripheral. The feature may comprise or be included in a game or a portion of a game, such as a bonus round.

It should be understood that the methods, techniques, and actions performed by a gaming system as described in the above exemplary embodiments can be performed programmatically, or as a computer-implemented method. Programmatically, as used herein, means through the use of code or computer-executable instructions. These instructions can be stored in one or more memory resources of the computing device. A programmatically performed step may or may not be automatic. The exemplary embodiments can be implemented using programmatic modules, engines, or components. A programmatic module, engine, or component can include a program, a sub-routine, a portion of a program, or a software component or a hardware component capable of performing one or more stated tasks or functions. As used herein, a module or component can exist on a hardware component independently of other modules or components. Alternatively, a module or component can be a shared element or process of other modules, programs or machines.

Computer Program

In some embodiments, the methods, systems, and media disclosed herein include at least one computer program, or use of the same. A computer program includes a sequence of instructions, executable in the digital processing device's CPU, written to perform a specified task. Computer readable instructions may be implemented as program modules, such as functions, objects, Application Programming Interfaces (APIs), data structures, and the like, that perform particular tasks or implement particular abstract data types. In light of the disclosure provided herein, those of skill in the art will recognize that a computer program may be written in various versions of various languages.

The functionality of the computer readable instructions may be combined or distributed as desired in various environments. In some embodiments, a computer program comprises one sequence of instructions. In some embodiments, a computer program comprises a plurality of sequences of instructions. In some embodiments, a computer program is provided from one location. In other embodiments, a computer program is provided from a plurality of locations. In various embodiments, a computer program includes one or more software modules. In various embodiments, a computer program includes, in part or in whole, one or more web applications, one or more mobile applications, one or more standalone applications, one or more web browser plug-ins, extensions, add-ins, or add-ons, or combinations thereof.

Web Application

In some embodiments, a computer program includes a web application. In light of the disclosure provided herein, those of skill in the art will recognize that a web application, in various embodiments, utilizes one or more software frameworks and one or more database systems. In some embodiments, a web application is created upon a software framework such as Microsoft® .NET or Ruby on Rails (RoR). In some embodiments, a web application utilizes one or more database systems including, by way of non-limiting examples, relational, non-relational, object oriented, associative, and XML database systems. In further embodiments, suitable relational database systems include, by way of non-limiting examples, Microsoft® SQL Server, mySQL™ and Oracle®. Those of skill in the art will also recognize that a web application, in various embodiments, is written in one or more versions of one or more languages. A web application may be written in one or more markup languages, presentation definition languages, client-side scripting languages, server-side coding languages, database query languages, or combinations thereof. In some embodiments, a web application is written to some extent in a markup language such as Hypertext Markup Language (HTML), Extensible Hypertext Markup Language (XHTML), or eXtensible Markup Language (XML). In some embodiments, a web application is written to some extent in a presentation definition language such as Cascading Style Sheets (CSS). In some embodiments, a web application is written to some extent in a client-side scripting language such as Asynchronous Javascript and XML (AJAX), Flash® Actionscript, Javascript, or Silverlight®. In some embodiments, a web application is written to some extent in a server-side coding language such as Active Server Pages (ASP), ColdFusion, Perl, Java™, JavaServer Pages (JSP), Hypertext Preprocessor (PHP), Python™, Ruby, Tcl, Smalltalk, WebDNA®, or Groovy. In some embodiments, a web application is written to some extent in a database query language such as Structured Query Language (SQL). In some embodiments, a web application integrates enterprise server products such as IBM® Lotus Domino®. In some embodiments, a web application includes a media player element. In various further embodiments, a media player element utilizes one or more of many suitable multimedia technologies including, by way of non-limiting examples, Adobe® Flash®, HTML 5, Apple® QuickTime®, Microsoft® Silverlight®, Java™, and Unity®.

Mobile Application

In some embodiments, a computer program includes a mobile application provided to a mobile digital processing device. In some embodiments, the mobile application is provided to a mobile digital processing device at the time it is manufactured. In other embodiments, the mobile application is provided to a mobile digital processing device via the computer network described herein.

In view of the disclosure provided herein, a mobile application is created by techniques known to those of skill in the art using hardware, languages, and development environments known to the art. Those of skill in the art will recognize that mobile applications are written in several languages. Suitable programming languages include, by way of non-limiting examples, C, C++, C #, Objective-C, Java™, Javascript, Pascal, Object Pascal, Python™, Ruby, VB.NET, WML, and XHTML/HTML with or without CSS, or combinations thereof.

Suitable mobile application development environments are available from several sources. Commercially available development environments include, by way of non-limiting examples, AirplaySDK, alcheMo, Appcelerator®, Celsius, Bedrock, Flash Lite, .NET Compact Framework, Rhomobile, and WorkLight Mobile Platform. Other development environments are available without cost including, by way of non-limiting examples, Lazarus, MobiFlex, MoSync, and Phonegap. Also, mobile device manufacturers distribute software developer kits including, by way of non-limiting examples, iPhone and iPad (iOS) SDK, Android™ SDK, BlackBerryx SDK, BREW SDK, Palm® OS SDK, Symbian SDK, webOS SDK, and Windows® Mobile SDK.

Those of skill in the art will recognize that several commercial forums are available for distribution of mobile applications including, by way of non-limiting examples, Apple® App Store, Android™ Market, BlackBerry® App World, App Store for Palm devices, App Catalog for webOS, Windows® Marketplace for Mobile, Ovi Store for Nokia® devices, Samsung® Apps, and Nintendo® DSi Shop.

Standalone Application

In some embodiments, a computer program includes a standalone application, which is a program that is run as an independent computer process, not an add-on to an existing process, e.g., not a plug-in. Those of skill in the art will recognize that standalone applications are often compiled. A compiler is a computer program(s) that transforms source code written in a programming language into binary object code such as assembly language or machine code. Suitable compiled programming languages include, by way of non-limiting examples, C, C++, Objective-C, COBOL, Delphi, Eiffel, Java™, Lisp, Python™, Visual Basic, and VB .NET, or combinations thereof. Compilation is often performed, at least in part, to create an executable program. In some embodiments, a computer program includes one or more executable complied applications.

Software Modules

In some embodiments, the methods, systems, and media disclosed herein include software, server, and/or database modules, or use of the same. In view of the disclosure provided herein, software modules are created by techniques known to those of skill in the art using machines, software, and languages known to the art. The software modules disclosed herein are implemented in a multitude of ways. In various embodiments, a software module comprises a file, a section of code, a programming object, a programming structure, or combinations thereof. In further various embodiments, a software module comprises a plurality of files, a plurality of sections of code, a plurality of programming objects, a plurality of programming structures, or combinations thereof. In various embodiments, the one or more software modules comprise, by way of non-limiting examples, a web application, a mobile application, and a standalone application. In some embodiments, software modules are in one computer program or application. In other embodiments, software modules are in more than one computer program or application. In some embodiments, software modules are hosted on one machine. In other embodiments, software modules are hosted on more than one machine. In further embodiments, software modules are hosted on cloud computing platforms. In some embodiments, software modules are hosted on one or more machines in one location. In other embodiments, software modules are hosted on one or more machines in more than one location.

Databases

In some embodiments, the methods, systems, and media disclosed herein include one or more databases, or use of the same. In view of the disclosure provided herein, those of skill in the art will recognize that many databases are suitable for storage and retrieval of player and game information. In various embodiments, suitable databases include, by way of non-limiting examples, relational databases, non-relational databases, object oriented databases, object databases, entity-relationship model databases, associative databases, and XML, databases. In some embodiments, a database is internet-based. In further embodiments, a database is web-based.

In still further embodiments, a database is cloud computing-based. In other embodiments, a database is based on one or more local computer storage devices.

General Information Relating to Various Embodiments of the Invention

A controller, computing device, or computer, such as described herein, may include at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

In some embodiments, a controller may include a processor, which as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Other aspects and features of the invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Those skilled in the art will readily appreciate that the systems and methods described herein may be a standalone system, gaming device, gaming machine or incorporated in an existing gaming system or machine. The gaming machine of the invention may include various computer and network related software and hardware, such as programs, operating systems, memory storage devices, data input/output devices, data processors, servers with links to data communication systems, wireless or otherwise, and data transceiving terminals. It should also be understood that any method steps discussed herein, such as for example, steps involving the receiving or displaying of data, may further include or involve the transmission, receipt and processing of data through conventional hardware and/or software technology to effectuate the steps as described herein. Those skilled in the art will further appreciate that the precise types of software and hardware used are not vital to the full implementation of the methods of the invention so long as players and operators thereof are provided with useful access thereto, either through a mobile device, gaming platform, or other computing platform via a local network or global telecommunication network.

Although specific features of various embodiments of the invention may be shown in some drawings and not in others, this is for convenience only. In accordance with the principles of the invention, any feature of a drawing may be referenced and/or claimed in combination with any feature of any other drawing.

Those skilled in the art will readily appreciate that the apparatus described herein may include various computer and network related software and hardware, such as programs, operating systems, memory storage devices, data input/output devices, data processors, servers with links to data communication systems, wireless or otherwise, and data transceiving terminals. Those skilled in the art will further appreciate that the precise types of software and hardware used are not vital to the full implementation of the apparatus of the invention so long as it performs as described in at least one of the embodiments herein.

While exemplary apparatus, systems and methods of the invention have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the scope of the invention in any way. Accordingly, the invention embraces alternatives, modifications and variations which fall within the spirit and scope of the invention as set forth by the claims and any equivalents thereto.

The invention claimed is:

1. A gaming system, comprising:

a housing;

at least one display device supported by the housing;

one or more input devices, wherein at least one of the one or more input devices is a payment device configured to receive a transfer of a monetary amount;

at least one processor;

a random number generator;

and at least one memory device that stores a plurality of instructions that, when executed by the at least one processor, cause the at least one processor to communicate with the at least one display device, the random number generator and the one or more input devices to:

a) establish a credit balance relating to the monetary amount received through the one or more input devices;

b) receive a wager through an interaction with the one or more input devices to initiate play of a wagering game, the wager being associated with a credit amount and the credit balance being decreasable by the credit amount of the wager;

c) randomly display on the at least one display device supported by the housing an outcome of an instance of play of the wagering game, wherein the displayed game outcome includes a depiction on the at least one display device of an array formed by at least one row and two columns defining adjacent first and second cells, the first cell having a first half image of a plurality of first half images stored in the at least one memory device, the first half image being randomly selected by the at least one processor in communication with the random number generator for display only in the first cell, the second cell having a second half image of a plurality of second half images stored in the memory device being randomly selected by the at least one processor in communication with the random number generator for display only in the second cell, wherein each first half image of the plurality of first half images stored in the at least one memory device includes at least one second half image of the plurality of second half images stored in the at least one memory device defined by the at least one processor as being a matching half image, wherein all of the first half images and the second half images of the pluralities of first half images and second half images form a unitary image responsive to being displayed in the adjacent first and second cells of the array, the unitary image formed being one of non-matching images of a currency or matching images of a currency, the unitary image formed of matching images of a currency identifying a credit award;

d) determine an award outcome based on the unitary image formed of matching images of a currency in any adjacent first and second cells in the array included in the displayed game outcome of the instance of the wagering game, wherein the award outcome is equal to the credit award identified by the unitary image formed of matching images in the displayed game outcome without respect to a payline or the position of the unitary image in the array; and e) responsive to the determination of the award outcome, increase the credit balance by the determined credit award.

2. The gaming system as recited by claim 1, wherein the payment device comprises a ticket acceptor.

3. The gaming system of claim 1, wherein the credit award is identified responsive to the formation of the unitary image formed of matching images.

4. A gaming system, comprising:

one or more input devices, wherein at least one of the one or more input devices includes a display device and a data communication device;

at least one processor;

a random number generator;

and one or more memory devices that store a plurality of instructions that, when executed by the at least one processor, cause the at least one processor to communicate with the data communication device of the at least one of the one or more input devices including the display device and the random number generator to:

a) establish a credit balance in the one or more memory devices;

b) receive a wager through an interaction with the at least one of the one or more input devices including the display device to initiate play of a wagering game, the wager being associated with a credit amount and the credit balance being decreasable by the credit amount of the wager;

c) randomly display on the at least one of the one or more input devices including the display device an outcome of an instance of play of the wagering game, wherein the displayed game outcome includes a depiction on the display device of an array formed by at least one row and two columns defining adjacent first and second cells, the first cell having a first half image of a plurality of first half images stored in the one or more memory devices, the first half image being randomly selected by the at least one processor in communication with the random number generator for display only in the first cell, the second cell having a second half image of a plurality of second half images stored in the one or more memory devices being randomly selected by the at least one processor in communication with the random number generator for display only in the second cell, wherein each first half image of the plurality of first half images stored in the one or more memory devices includes at least one second half image of the plurality of second half images stored in the one or more memory devices defined by the at least one processor as being a matching half image, wherein all of the first half images and the second half images of the pluralities of first half images and second half images form a complete image responsive to being displayed in the adjacent first and second cells of the array, the complete image formed being one of non-matching images of a currency or matching images of a currency, the complete image formed of matching images of a currency identifying a credit award;

d) determine an award outcome based on the complete image formed of matching images of a currency in any adjacent first and second cells in the array included in the displayed game outcome of the instance of the wagering game, wherein the award outcome is equal to the credit award identified by the complete image formed of matching images in the displayed game outcome without respect to a payline or the position of the unitary image in the array; and e) responsive to the determination of the award outcome, increase the credit balance by the determined credit award.

5. A method facilitated by one or more input devices, wherein at least one of the one or more input devices includes a display device and a data communication device; at least one processor; a random number generator; and one or more memory devices that store a plurality of instructions, the at least one processor executing the plurality of instructions and communicating with the data communication device of the at least one of the one or more input devices including the display device, the method comprising the steps of:

a) establishing a credit balance in the one or more memory devices;

b) receiving a wager through an interaction with the at least one of the one or more input devices including the display device to initiate play of a wagering game, the wager being associated with a credit amount and the credit balance being decreasable by the credit amount of the wager;

c) randomly displaying on the at least one of the one or more input devices including the display device an outcome of an instance of play of the wagering game, wherein the displayed game outcome includes a depiction on the display device of an array formed by at least one row and two columns defining adjacent first and second cells, the first cell having a first half image of a plurality of first half images stored in the one or more memory devices, the first half image being randomly selected by the at least one processor in communication with the random number generator for display only in the first cell, the second cell having a second half image of a plurality of second half images stored in the one or more memory devices being randomly selected by the at least one processor in communication with the random number generator for display only in the second cell, wherein each first half image of the plurality of first half images stored in the one or more memory devices includes at least one second half image of the plurality of second half images stored in the one or more memory devices defined by the at least one processor as being a matching half image, wherein all of the first half images and the second half images of the pluralities of first half images and second half images form a unitary image, the unitary image formed being one of non-matching images of a currency or matching images of a currency, the unitary image formed of matching images of a currency identifying a credit award;

d) determining an award outcome based on the unitary image formed of matching images of a currency in any adjacent first and second cells in the array included in the displayed game outcome of the instance of the wagering game, wherein the award outcome is equal to the credit award identified by the unitary image formed of matching images in the displayed game outcome without respect to a payline or the position of the unitary image in the array; and e) responsive to the determination of the award outcome, increasing the credit balance by the determined credit award.

6. The method of claim 5, further comprising the step of identifying the credit award responsive to the formation of the unitary image formed of matching images.

* * * * *